US009429908B2

(12) United States Patent
Uto et al.

(10) Patent No.: US 9,429,908 B2
(45) Date of Patent: Aug. 30, 2016

(54) CONNECTOR, PROCESS CARTRIDGE, AND IMAGE FORMING APPARATUS

(71) Applicant: FUJI XEROX CO., LTD., Tokyo (JP)

(72) Inventors: Osamu Uto, Kanagawa (JP); Tatsuya Soga, Kanagawa (JP); Kazuhiro Yoshioka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/718,900

(22) Filed: May 21, 2015

(65) Prior Publication Data

US 2016/0161912 A1 Jun. 9, 2016

(30) Foreign Application Priority Data

Dec. 4, 2014 (JP) ..... 2014-245953

(51) Int. Cl.

| | |
|---|---|
| ***G03G 21/16*** | (2006.01) |
| ***G03G 21/18*** | (2006.01) |
| ***H01R 13/66*** | (2006.01) |
| ***H01R 13/73*** | (2006.01) |

(52) U.S. Cl.
CPC ..... *G03G 21/1867* (2013.01); *H01R 13/665* (2013.01); *H01R 13/73* (2013.01)

(58) Field of Classification Search
CPC ..... G03G 21/1867; H01R 13/665
USPC ..... 399/12, 13, 107, 111, 119
See application file for complete search history.

(56) References Cited

U.S. PATENT DOCUMENTS 6,014,533 A 1/2000 Kawana

FOREIGN PATENT DOCUMENTS

| | | |
|---|---|---|
| EP | 0 802 461 A2 | 10/1997 |
| JP | 09-213407 A | 8/1997 |
| JP | 10-312870 A | 11/1998 |

*Primary Examiner* — Hoang Ngo
(74) *Attorney, Agent, or Firm* — Sughrue Mion, PLLC

(57) ABSTRACT

A connector includes a first connector member and a second connector member. The first connector member retains an integrated circuit having multiple first electrodes in a secured state and is externally contactable with the multiple first electrodes. The second connector member is attachable to and detachable from the first connector member and has a connection unit that is directly connected to the multiple first electrodes of the integrated circuit when the first connector member is attached to the second connector member.

3 Claims, 14 Drawing Sheets

CONNECTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2014-245953 filed Dec. 4, 2014.

BACKGROUND

Technical Field

The present invention relates to connectors, process cartridges, and image forming apparatuses.

SUMMARY

According to an aspect of the invention, there is provided a connector including a first connector member and a second connector member. The first connector member retains an integrated circuit having multiple first electrodes in a secured state and is externally contactable with the multiple first electrodes. The second connector member is attachable to and detachable from the first connector member and has a connection unit that is directly connected to the multiple first electrodes of the integrated circuit when the first connector member is attached to the second connector member.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described below with reference to the drawings.

First Exemplary Embodiment

Figure 1:
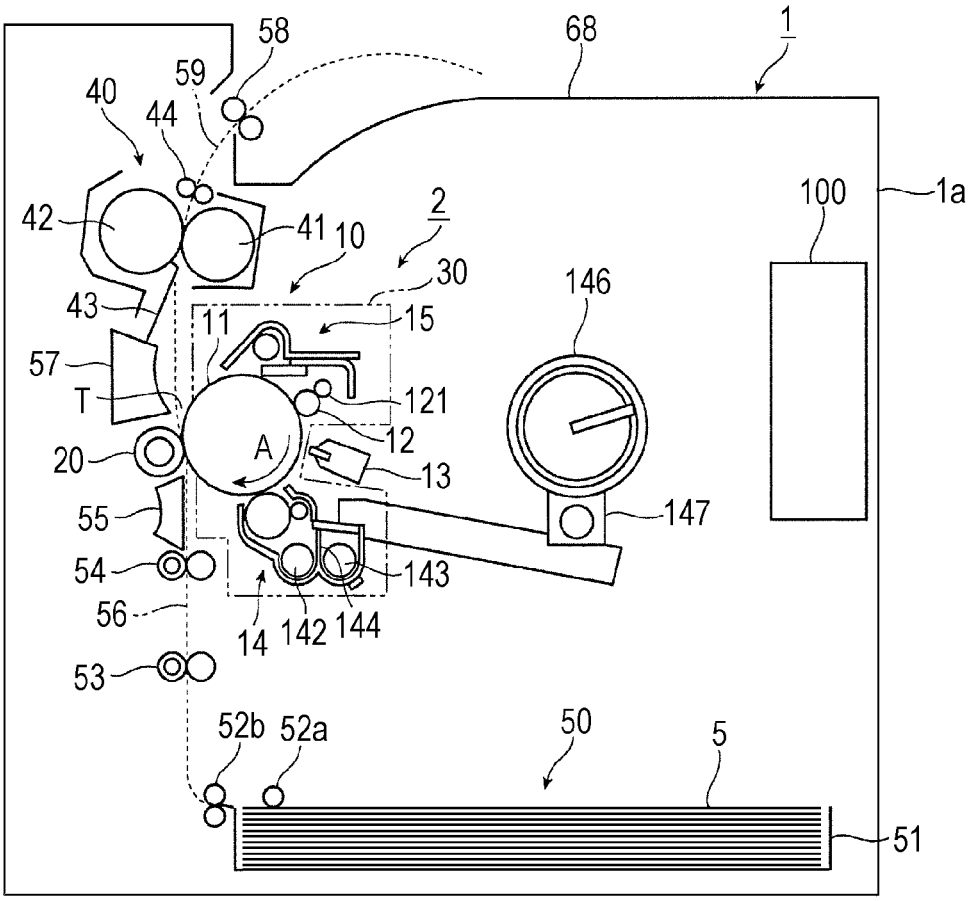
FIG. 1 illustrates the overall configuration of an image forming apparatus according to a first exemplary embodiment of the present invention.
Figure 2:
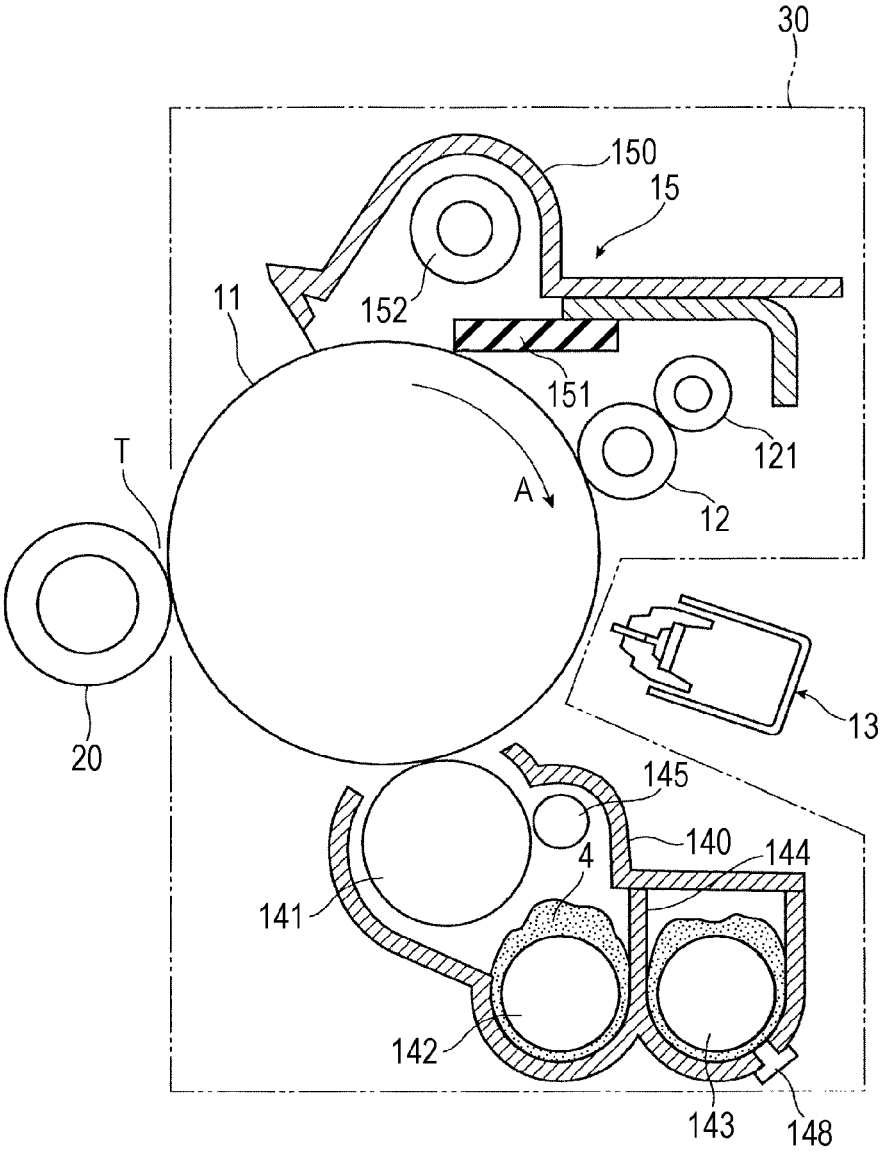
FIG. 2 illustrates the configuration of an image forming section of the image forming apparatus according to the first exemplary embodiment of the present invention.

FIG. 1 schematically illustrates the overall configuration of an image forming apparatus to which a connector and a process cartridge according to a first exemplary embodiment of the present invention are applied. FIG. 2 is an enlarged view illustrating a relevant part (such as an image forming device) in the image forming apparatus.

Overall Configuration of Image Forming Apparatus

An image forming apparatus 1 according to the first exemplary embodiment is, for example, a monochrome printer. The image forming apparatus 1 includes an image forming section 2 as an example of an image forming unit that forms an image onto a recording medium based on image data.

The image forming section 2 includes, for example, an image forming device 10 that forms a toner image to be developed by using a toner, which constitutes a developer; a transfer device 20 that transfers the toner image formed by the image forming device 10 onto recording paper 5 as an example of a recording medium; a paper feed device 50 that accommodates therein predetermined recording paper 5 to be fed to a transfer position T of the transfer device 20 and that transports the recording paper 5 thereto; and a fixing device 40 that fixes the toner image, which has been transferred on the recording paper 5 by the transfer device 20, onto the recording paper 5. In FIG. 1, reference character 1*a* denotes an image forming apparatus body formed of, for example, a support structure member, such as a frame, and an external cover.

The image forming device 10 is a single dedicated image forming device for forming a black (K) toner image. The image forming device 10 is disposed at a predetermined position located toward one sidewall (i.e., left sidewall in FIG. 1) in the internal space of the image forming apparatus body 1*a*.

As shown in FIG. 1, the image forming device 10 includes a photoconductor drum 11 as an example of a rotatable image bearing member. The photoconductor drum 11 is surrounded by the following devices. Such devices include a charging device 12 that electrostatically charges an image formable peripheral surface (i.e., image bearing surface) of the photoconductor drum 11 to a predetermined potential; an exposure device 13 as an example of an electrostatic-latent-image forming unit that radiates light onto the electrostatically-charged peripheral surface of the photoconductor drum 11 based on image information (signal) so as to form an electrostatic latent image having a potential difference; a developing device 14 as an example of a developing unit that develops the electrostatic latent image into a toner image by using a black (K) toner contained in a developer; and a drum cleaning device 15 that removes extraneous matter, such as residual toner, from the image bearing surface of the photoconductor drum 11 after the transfer process so as to clean the image bearing surface of the photoconductor drum 11.

The photoconductor drum 11 is obtained by forming the image bearing surface having a photoconductor layer (photosensitive layer) composed of a photosensitive material around the peripheral surface of an electrically-grounded cylindrical or columnar base. The photoconductor drum 11 is supported such that it is rotatable in a direction indicated by an arrow A by receiving a driving force transmitted from a rotational driving device (not shown).

The charging device 12 is of a contact type, such as a charging roller disposed in contact with the photoconductor drum 11. The charging device 12 receives charge voltage from a charge high-voltage power supply device (not shown). With regard to the charge voltage, in a case where the developing device 14 is configured to perform reversal development, a voltage or a current with the same polarity as the charge polarity of the toner supplied from the developing device 14 is supplied to the charging device 12. The charging device 12 includes a roller-shaped cleaning member 121 that cleans the peripheral surface of the charging roller.

The exposure device 13 is configured to radiate light onto the electrostatically-charged peripheral surface of the photoconductor drum 11 in accordance with image information input to the image forming apparatus 1 so as to form an electrostatic latent image on the peripheral surface. When the exposure device 13 is to form an electrostatic latent image, image information (signal) input to the image forming apparatus 1 via an arbitrary unit is transmitted to the exposure device 13.

The exposure device 13 is constituted of a light-emitting-diode (LED) print head that radiates light according to the image information onto the photoconductor drum 11 by using LEDs as multiple light emitting elements arranged in the axial direction of the photoconductor drum 11, so as form the electrostatic latent image. The exposure device 13 may alternatively be configured to scan laser light according to the image information across the photoconductor drum 11 in the axial direction thereof.

As shown in FIG. 2, the developing device 14 includes, for example, a developing roller 141, stirring transport members 142 and 143, a partition wall 144, and a roller-shaped layer-thickness regulating member 145, which are disposed within a housing 140 having an opening and accommodation chambers for a developer 4. The developing roller 141 retains the developer 4 and transports the developer 4 to a development region that faces the photoconductor drum 11. The stirring transport members 142 and 143 are, for example, screw augers that transport the developer 4 to make the developer 4 pass the developing roller 141 while stirring the developer 4. The partition wall 144 separates a first accommodation chamber, which accommodates the stirring transport member 142 therein, from a second accommodation chamber, which accommodates the stirring transport member 143 therein. The layer-thickness regulating member 145 regulates the amount (i.e. layer thickness) of developer retained on the developing roller 141. A power supply device (not shown) supplies development voltage between the developing roller 141 of the developing device 14 and the photoconductor drum 11. Each of the developing roller 141 and the stirring transport members 142 and 143 rotates in a predetermined direction by receiving a driving force transmitted from a rotational driving device (not shown). Furthermore, the aforementioned developer 4 used is a two-component developer containing a nonmagnetic toner and a magnetic carrier. In FIG. 1, reference character 146 denotes a toner cartridge as an example of a developer container that accommodates therein a developer that at least contains a toner, and reference character 147 denotes a developer supplying device that supplies the developer from the toner cartridge 146 to the developing device 14.

The developing device 14 includes a toner concentration sensor 148 as an example of a toner-concentration detector that detects the toner concentration in the developer 4 accommodated within the housing 140. The toner concentration sensor 148 is attached to a lower wall surface of the second accommodation chamber, which is where the housing 140 accommodates the stirring transport member 143. The toner concentration sensor 148 used is, for example, a magnetic permeability sensor.

The transfer device 20 is of a contact type equipped with a rotatable transfer roller that comes into contact with the peripheral surface of the photoconductor drum 11 at the transfer position T and that is supplied with transfer voltage. With regard to the transfer voltage, a direct-current voltage with a reversed polarity relative to the charge polarity of the toner is supplied from a power supply device (not shown).

As shown in FIG. 2, the drum cleaning device 15 includes a cleaning plate 151 that is disposed within a container-shaped body 150 and removes extraneous matter, such as residual toner, and a transport member 152 such as a screw auger (not shown) that transports the extraneous matter collected by the cleaning plate 151 to an external container. The cleaning plate 151 used is a plate-shaped member (such as a blade) composed of, for example, a rubber material.

Figure 3:
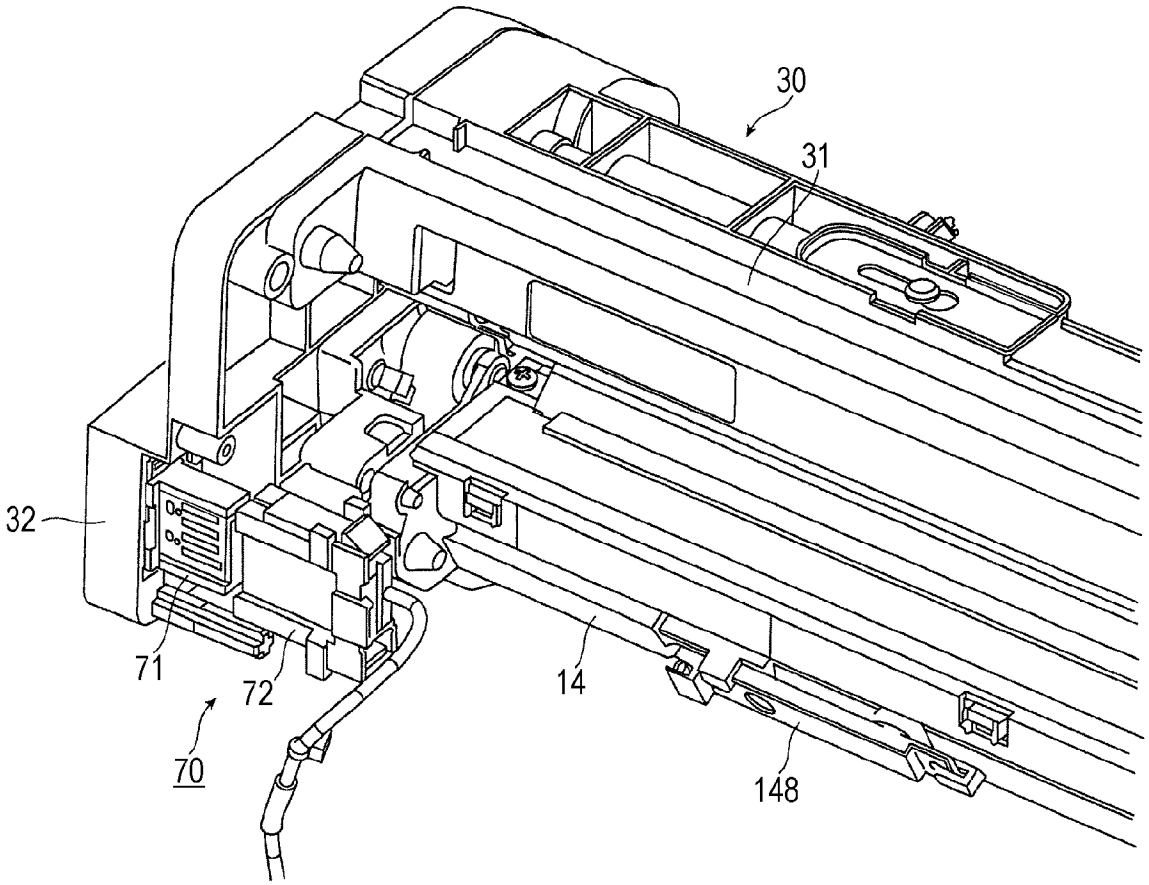
FIG. 3 is a perspective view illustrating a relevant part of a process cartridge.
Figure 4:
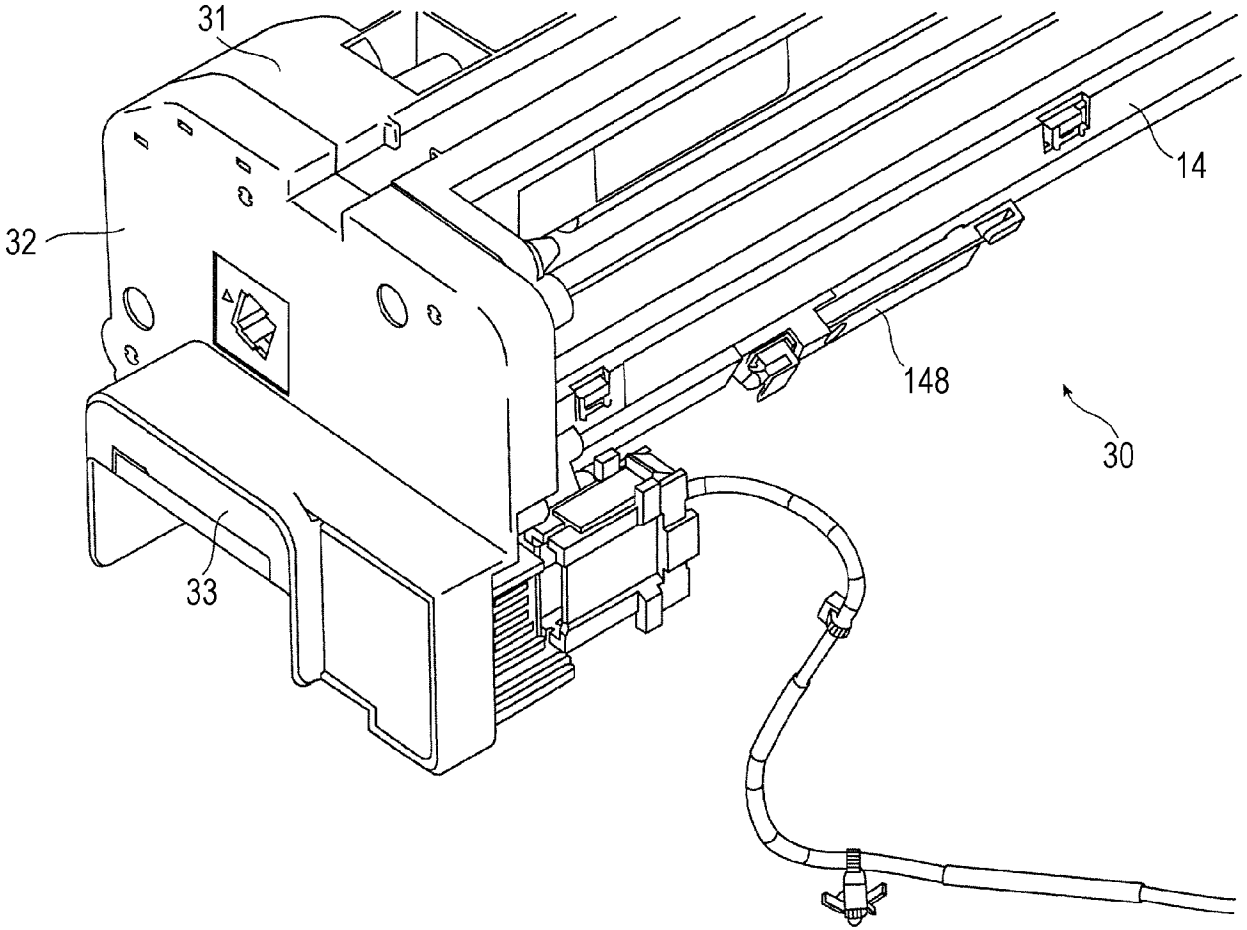
FIG. 4 is a perspective view illustrating a relevant part of the process cartridge.

In this exemplary embodiment, the image forming components, such as the photoconductor drum 11 as well as the charging device 12, the developing device 14, and the drum cleaning device 15 disposed around the photoconductor drum 11, are integrally combined so as to constitute a process cartridge 30 as an example of a replaceable unit. As shown in FIG. 3, the process cartridge 30 includes a process cartridge body 31 to which the photoconductor drum 11, the charging device 12, the developing device 14, and the drum cleaning device 15 are integrally attached. The process cartridge 30 is attachable to and detachable from the image forming apparatus body 1*a*. As shown in FIG. 4, a front frame 32 of the process cartridge body 31 is provided with a handle 33 to be manually gripped when attaching or detaching the process cartridge 30 to or from the image forming apparatus body 1*a*. Instead of including all of the image forming components, such as the photoconductor drum 11 as well as the charging device 12, the developing device 14, and the drum cleaning device 15 disposed around the photoconductor drum 11, the process cartridge 30 may include some of these image forming components, such as the photoconductor drum 11, the charging device 12, and the developing device 14 or the photoconductor drum 11 and the developing device 14.

Figure 5:
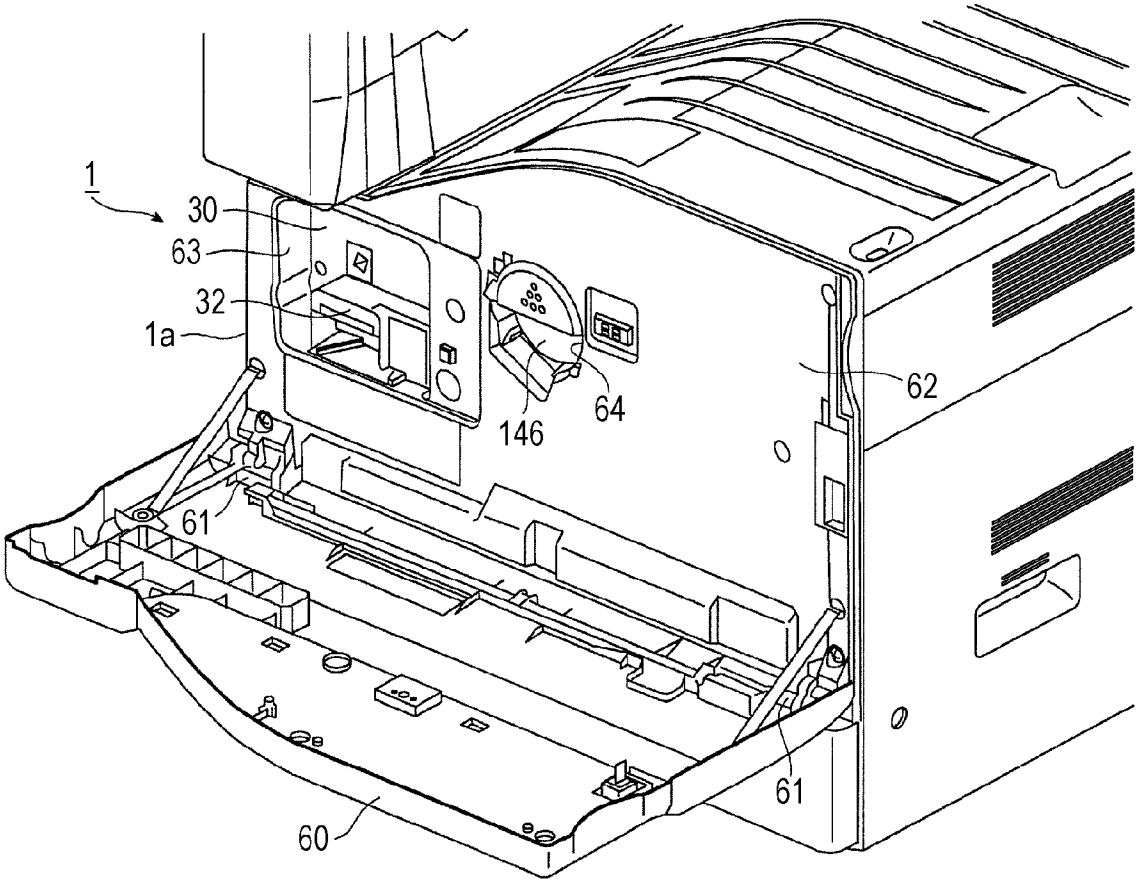
FIG. 5 is a perspective view illustrating a state where a front cover of the image forming apparatus is opened.

As shown in FIG. 5, the image forming apparatus body 1*a* includes a front cover 60 at the front side thereof (i.e., a side surface facing a user when operating). The front cover 60 is attached to the image forming apparatus body 1*a* in an openable-closable manner via a hinge 61 provided at a lower end of the front cover 60.

The image forming apparatus body 1*a* includes an internal cover 62 that becomes exposed by opening the front cover 60. The front surface of the internal cover 62 has a substantially rectangular opening 63 used for attaching and detaching the process cartridge 30 and a substantially circular opening 64 used for attaching and detaching the toner cartridge 146. The process cartridge 30 is attached to or detached from the image forming apparatus body 1*a* by being moved, via the opening 63, along a guide member, such as a guide rail (not shown), provided within the image forming apparatus body 1*a*. By becoming attached to the image forming apparatus body 1*a*, the process cartridge 30 receives a driving force and electric power from the image forming apparatus body 1*a*. Moreover, by being attached to the image forming apparatus body 1*a*, the process cartridge 30 becomes electrically connected to a controller 100 in the image forming apparatus body 1*a* via a connector 70, which will be described later, so as to become capable of exchanging electric signals (i.e., become communicable) therewith.

As shown in FIG. 1, the fixing device 40 includes, for example, a heating rotatable member 41 and a pressing rotatable member 42. The heating rotatable member 41 is of a roller type or a belt type (a roller type in this exemplary embodiment) that is heated by a heater so that the surface temperature of the heating rotatable member 41 is maintained at a preset temperature. The pressing rotatable member 42 is of a roller type or a belt type (a belt type in this exemplary embodiment) that rotates by coming into contact with the heating rotatable member 41 at a predetermined pressure. In the fixing device 40, a contact area where the heating rotatable member 41 and the pressing rotatable member 42 are in contact with each other serves as a fixing section that performs a predetermined fixing process (i.e., heating and pressing).

The paper feed device 50 is disposed at a lower position of the image forming apparatus body 1*a*. The paper feed device 50 includes a single (or multiple) paper accommodation member 51 that accommodates therein a stack of recording paper 5 of a desired size and type, and delivering devices 52*a* and 52*b* that deliver the recording paper 5 one-by-one from the paper accommodation member 51. The paper accommodation member 51 is, for example, attached in a manner such that it is ejectable toward the front side of the image forming apparatus body 1*a*.

A paper-feed transport path 56 that includes multiple pairs of paper transport rollers 53 and 54 and a transport guide member 55 is provided between the paper feed device 50 and the transfer device 20. The multiple pairs of paper transport rollers 53 and 54 transport the recording paper 5 delivered from the paper feed device 50 to the transfer position T. In the paper-feed transport path 56, the pair of paper transport rollers 54 disposed immediately in front of the transfer position T serves as, for example, rollers (registration rollers) that adjust the transport timing of the recording paper 5.

A transport guide member 57 that transports the recording paper 5 having the toner image transferred thereon by the transfer device 20 toward the fixing device 40 is disposed downstream of the transfer device 20. Moreover, the entrance of the fixing device 40 is provided with an entrance guide member 43 that guides the recording paper 5 toward the fixing section where the heating rotatable member 41 and the pressing rotatable member 42 are in contact with each other. The exit of the fixing device 40 is provided with a transport roller 44 that transports the recording paper 5 that has undergone the fixing process.

A paper-output transport path 59 is provided downstream of the fixing device 40. The paper-output transport path 59 includes a paper output roller 58 for outputting the recording paper 5 having the toner image fixed thereon by the fixing device 40 onto a paper output section 68 disposed at the top of the image forming apparatus body 1*a*.

In FIG. 1, reference character 100 denotes a controller that controls the overall operation of the image forming apparatus 1. The controller 100 includes, for example, a central processing unit (CPU), a read-only memory (ROM), a random access memory (RAM), and a bus or a communication interface that connects, for example, the CPU and the ROM.

Basic Operation of Image Forming Apparatus

The basic image forming operation performed by the image forming apparatus 1 will be described below.

The following description relates to image forming operation performed when forming a monochrome image constituted of a black toner image by using the image forming device 10.

When the image forming apparatus 1 receives command information requesting image forming operation (printing operation), for example, the image forming device 10, the transfer device 20 and the fixing device 40 start operating.

Then, in the image forming device 10, the photoconductor drum 11 first rotates in the direction of the arrow A, and the charging device 12 electrostatically charges the surface of the photoconductor drum 11 to a predetermined polarity (negative polarity in this exemplary embodiment) and a predetermined electric potential. Then, the exposure device 13 radiates light onto the electrostatically-charged surface of the photoconductor drum 11 based on an image signal input to the image forming apparatus 1 so as to form an electrostatic latent image having a predetermined potential difference on the surface.

Subsequently, the developing device 14 develops the electrostatic latent image formed on the photoconductor drum 11 by supplying a toner, which is electrostatically charged to a predetermined polarity (negative polarity), to the electrostatic latent image and electrostatically adhering the toner thereto. As a result of this developing process, the electrostatic latent image formed on the photoconductor drum 11 becomes a visible toner image developed using the toner. The developing device 14 consumes the toner by making the electrostatic latent image into a visible toner image. The toner concentration within the housing 140 of the developing device 14 is detected by the toner concentration sensor 148 disposed in the second accommodation chamber. A detection signal of the toner concentration sensor 148 is transmitted to the controller 100. Based on the toner concentration within the developing device 14 detected by the toner concentration sensor 148, the controller 100 drives a developer supplier 147 at a predetermined timing so as to supply the developer that at least contains the toner from the toner cartridge 146 to the developing device 14.

Subsequently, when the toner image formed on the photoconductor drum 11 of the image forming device 10 is transported to the transfer position T, the transfer device 20 transfers the toner image onto the recording paper 5.

In the image forming device 10 that has completed the transfer process, the drum cleaning device 15 cleans the surface of the photoconductor drum 11 by scraping off extraneous matter, such as residual toner, remaining on the surface of the photoconductor drum 11. Thus, the image forming device 10 becomes ready for subsequent image forming operation.

In the paper feed device 50, the predetermined recording paper 5 is delivered to the paper-feed transport path 56 in accordance with the image forming operation. In the paper-feed transport path 56, the pair of paper transport rollers 54 as registration rollers delivers the recording paper 5 to the transfer position T in accordance with the transfer timing.

Subsequently, the recording paper 5 having the toner image transferred thereon is transported to the fixing device 40 via the transport guide member 57. In the fixing device 40, the recording paper 5 that has undergone the transfer process is introduced to and made to pass through the fixing section between the rotating heating rotatable member 41 and the rotating pressing rotatable member 42 via the entrance guide member 43, so that a fixing process is performed on the recording paper 5. Thus, the unfixed toner image becomes fixed onto the recording paper 5. Finally, the recording paper 5 that has undergone the fixing process is output onto, for example, the paper output section 68, which is provided at the top of the image forming apparatus 1, by the paper output roller 58 via the paper-output transport path 59.

As a result of the above operation, the recording paper 5 having a monochrome image formed on one face thereof is output.

Every time the image forming operation is executed, the controller 100 accumulatively counts lifespan parameters, such as the number of rotations of the photoconductor drum 11 and the number of printed sheets. When the image forming operation is completed, the controller 100 writes the lifespan parameters, such as the counted number of rotations of the photoconductor drum 11 and the counted number of printed sheets, into a storage unit provided in the toner cartridge 146, which will be described later.

In the image forming apparatus 1, the layer thickness of the photoconductor layer of the photoconductor drum 11 decreases due to, for example, abrasion while the image forming operation is being continuously performed. Therefore, when the process cartridge 30 including the photoconductor drum 11 reaches its lifespan, such as when the layer thickness of the photoconductor layer of the photoconductor drum 11 decreases to a predetermined value, or when the process cartridge 30 reaches near its lifespan, the controller 100 detects this state based on the lifespan parameters. Then, the controller 100 causes a user interface (not shown) or a display screen of a personal computer connected to the image forming apparatus 1 to display a message prompting the user to replace the process cartridge 30. The user may then replace the process cartridge 30 as a replaceable unit with a new one.

The process cartridge 30 includes a customer replaceable unit memory (CRUM) 712 as an example of a storage unit (integrated circuit) that stores the lifespan parameters, such as the accumulative number of rotations of the photoconductor drum 11 and the accumulative number of printed sheets having images formed thereon by the process cartridge 30, and that is used for detecting the lifespan of the photoconductor drum 11. The information stored in the CRUM 712 may be information with which the lifespan of the photoconductor drum 11 is detectable. For example, in addition to or as an alternative to the accumulative number of rotations of the photoconductor drum 11 and the accumulative number of printed sheets, the information may include the accumulative number of pixels in image data, the accumulative operating time of the developing device 14, and the accumulative amount of toner supplied to the developing device 14.

Figure 6:
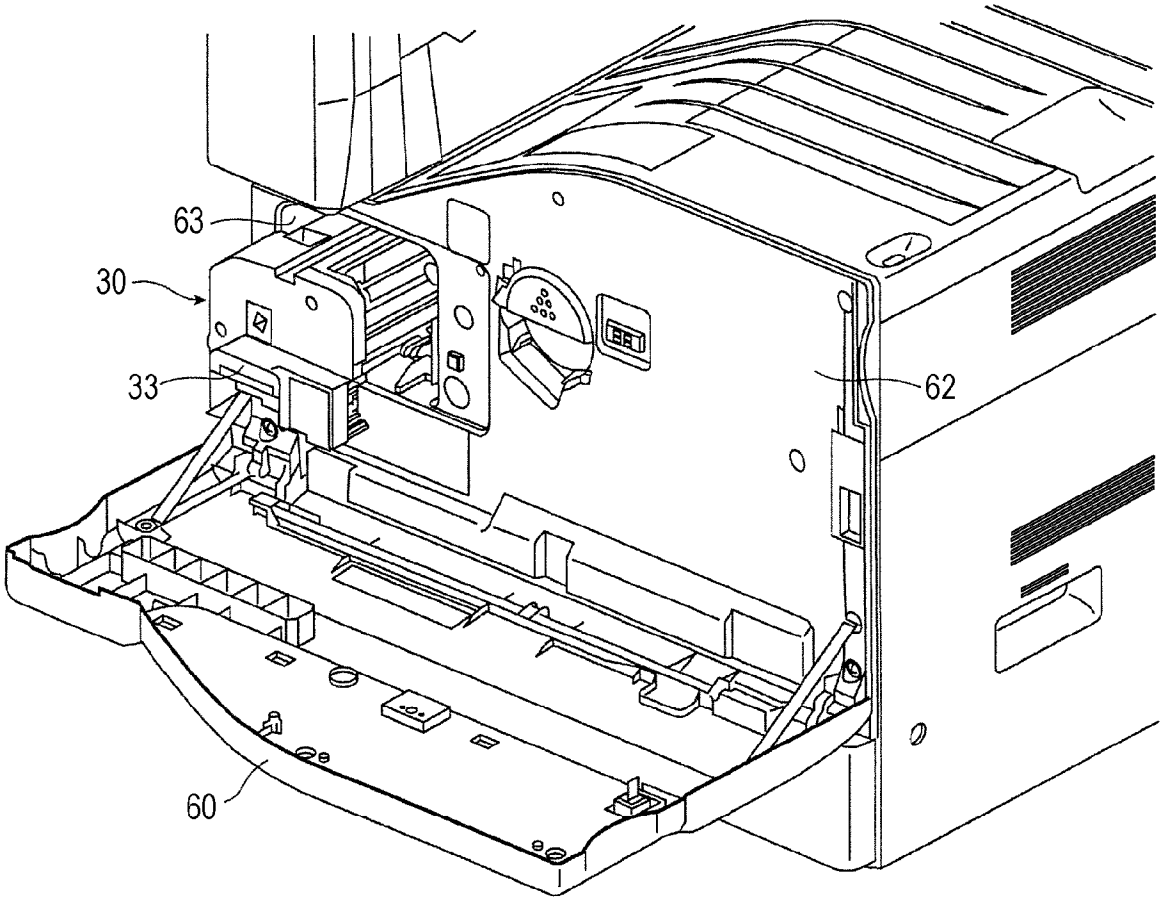
FIG. 6 is a perspective view illustrating a state where the process cartridge is ejected by opening the front cover of the image forming apparatus.

As shown in FIG. 6, in order to replace the process cartridge 30, the user opens the front cover 60 of the image forming apparatus body 1*a* and pulls the process cartridge 30 toward the front side of the image forming apparatus body 1*a* by using the handle 33 of the process cartridge 30, thereby taking the used process cartridge 30 out of the image forming apparatus body 1*a*.

Subsequently, a new process cartridge 30 is pushed through the opening 63 of the image forming apparatus body 1*a* to a predetermined position within the image forming apparatus body 1*a* while being guided by a guide member (not shown), so that the new process cartridge 30 becomes attached to the predetermined position of the image forming apparatus body 1*a*.

By being attached to the predetermined position of the image forming apparatus body 1*a*, the process cartridge 30 becomes capable of receiving a driving force and electric power from the image forming apparatus body 1*a* and also becomes electrically connected to the controller 100 in the image forming apparatus body 1*a*.

Figure 7:
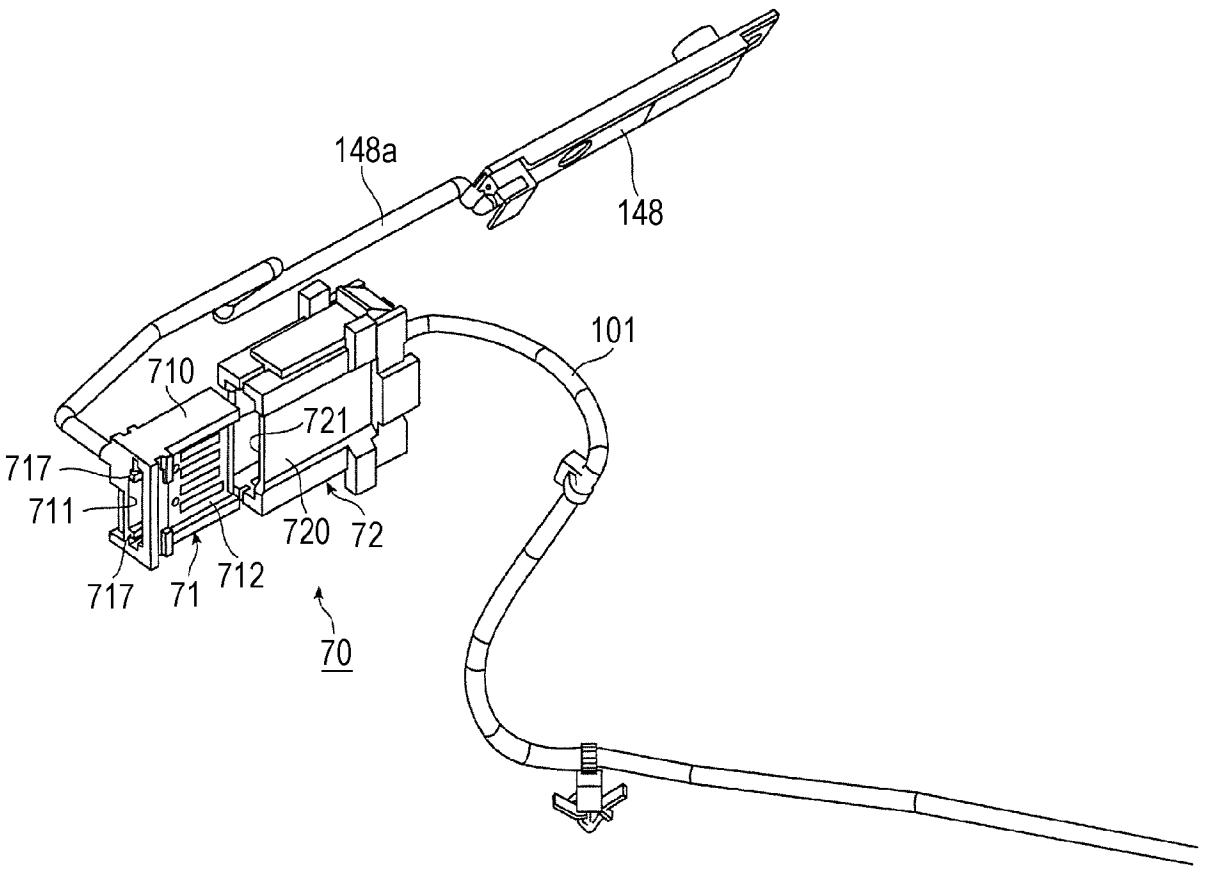
FIG. 7 is a perspective view illustrating a connector according to the first exemplary embodiment of the present invention.

As shown in FIG. 7, the image forming apparatus 1 includes a connector 70 used for electrically connecting and disconnecting the process cartridge 30 and the image forming apparatus body 1*a* to and from each other.

Configuration of Connector

Figure 8:
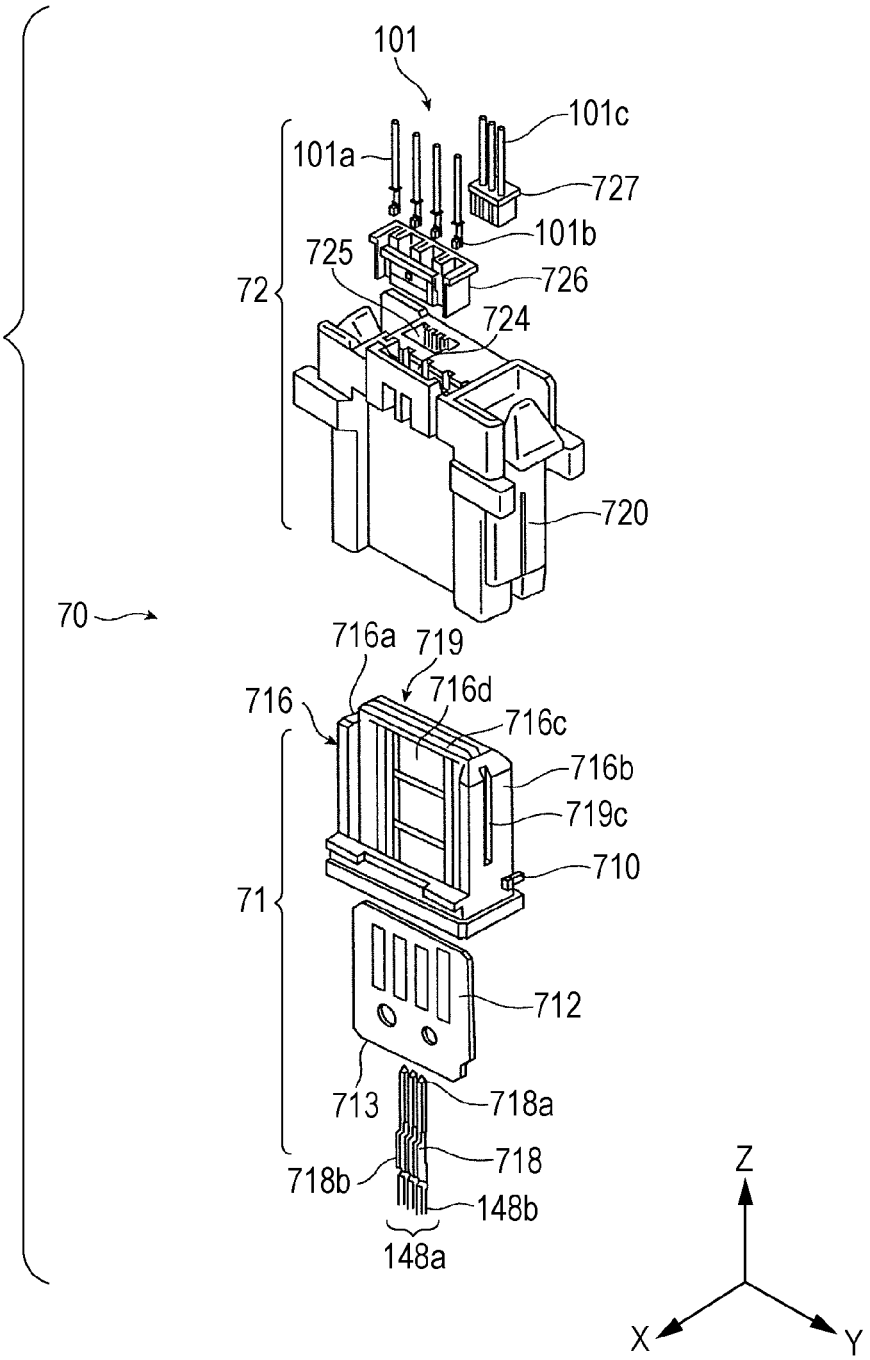
FIG. 8 is an exploded perspective view of the connector according to the first exemplary embodiment of the present invention.
Figure 9:
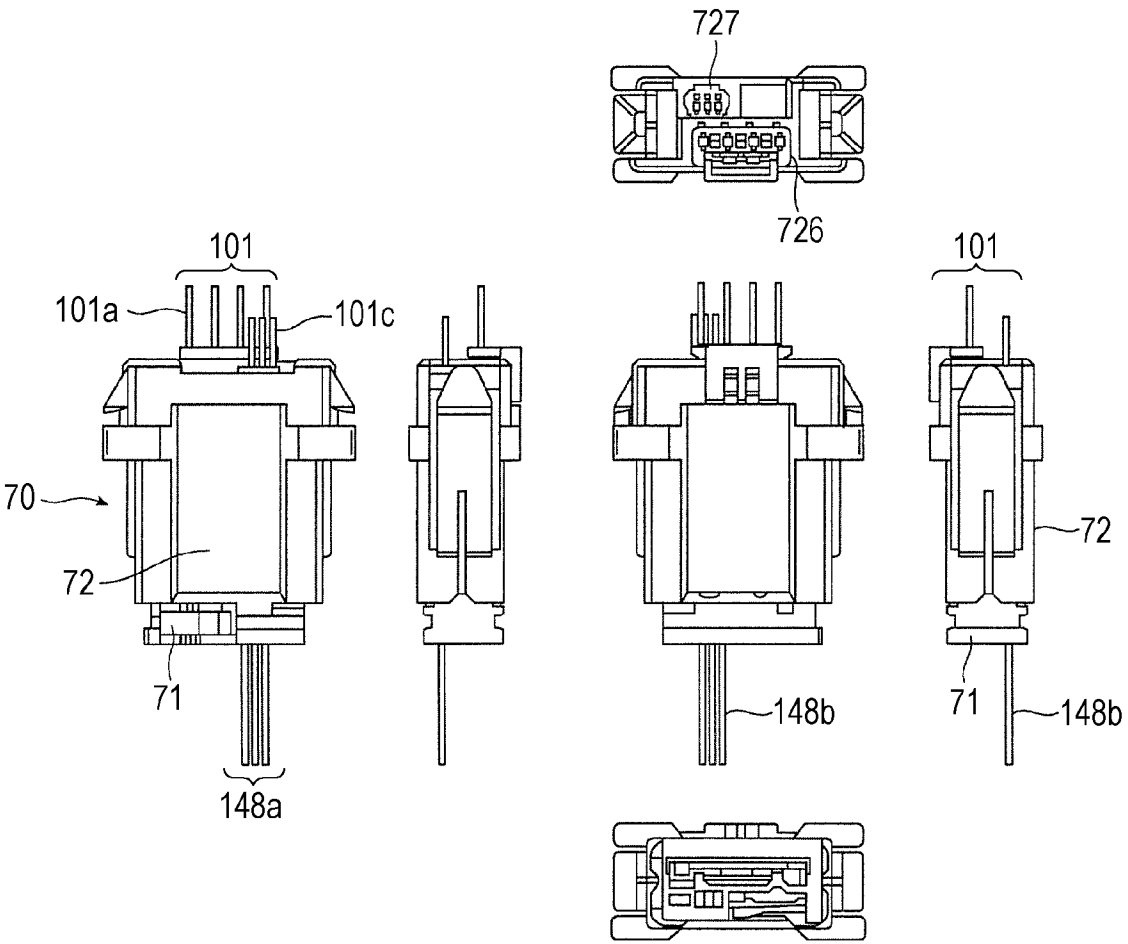
FIG. 9 illustrates a plug as viewed from six directions.

FIG. 7 is a perspective view illustrating the connector 70 according to the first exemplary embodiment of the present invention together with a wire harness. FIG. 8 is an exploded perspective view of the connector 70. FIG. 9 illustrates the connector 70 in an assembled state, as viewed from six directions.

Figure 10:
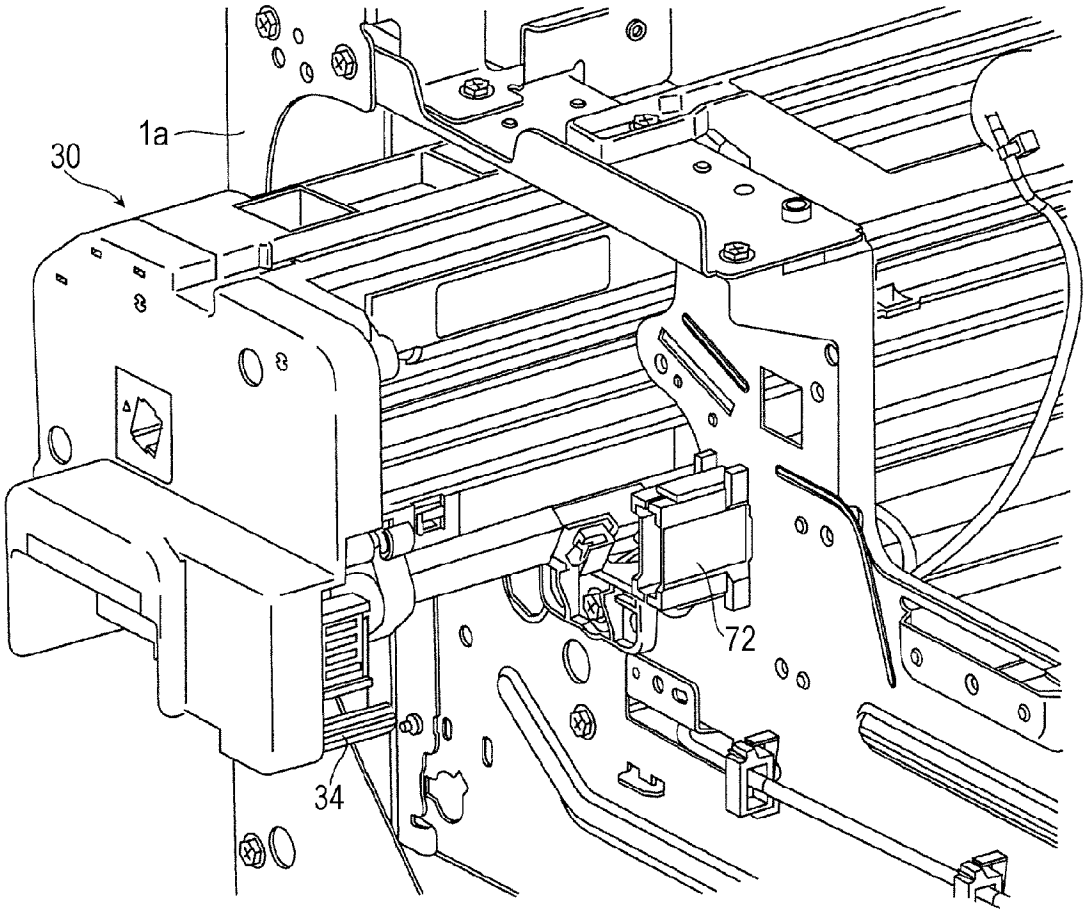
FIG. 10 is a perspective view illustrating a receptacle in an attached state.

As shown in FIGS. 7 to 9, the connector 70 includes a male plug 71 as an example of a first connector member to be attached to the process cartridge 30 and a female receptacle 72 as an example of a second connector member to be attached to the image forming apparatus body 1*a*. The plug 71 and the receptacle 72 are attachable and detachable to and from each other. As shown in FIG. 3, the plug 71 is attached in state where it is secured by being fitted or screwed to the inner surface (located inside the image forming apparatus body 1*a*) of the frame 32 of the process cartridge body 31. On the other hand, as shown in FIG. 10, the receptacle 72 is attached to the image forming apparatus body 1*a* at a position corresponding to the plug 71 of the process cartridge 30, which is a position where the process cartridge 30 is attached to the image forming apparatus body 1*a*, in a so-called floating state such that the receptacle 72 allows the process cartridge 30 to move relative to the image forming apparatus body 1*a* in two directions intersecting the attaching-detaching direction, namely, the vertical direction and the horizontal direction, so as to compensate for an error (i.e., positional displacement) in the attached position of the process cartridge 30. In FIG. 10, reference character 34 denotes a stopper member that is provided at the process cartridge 30 and is used for positioning the plug 71 by being brought into abutment with an internal frame 65 of the image forming apparatus body 1*a*.

Figure 11:
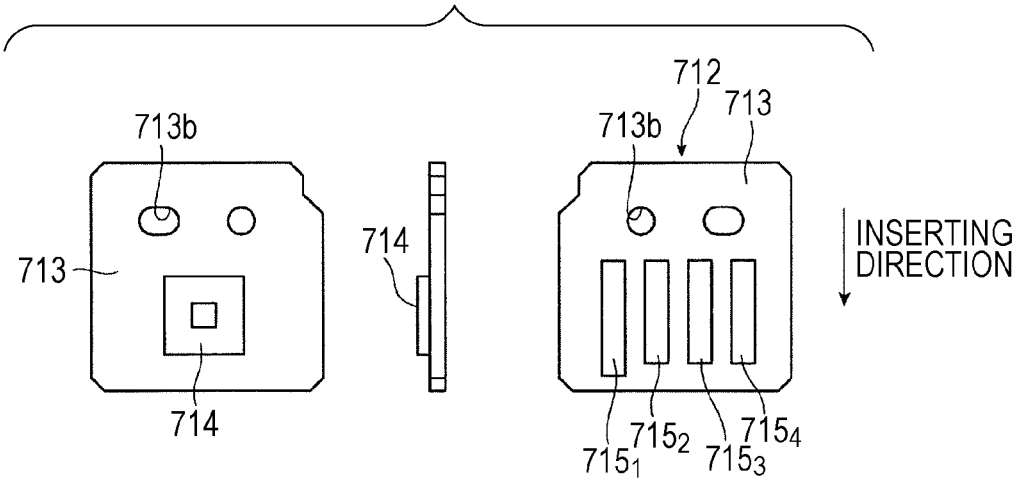
FIG. 11 illustrates the configuration of a customer replaceable unit memory (CRUM)

The plug 71 includes a substantially-rectangular-parallelepiped plug housing 710 composed of an insulation material, such as synthetic resin. As shown in FIG. 7, the plug housing 710 has a vertically-long rectangular shape whose width is smaller than the height thereof when viewed from the front side of the image forming apparatus 1. Furthermore, the front end surface of the plug housing 710 is provided with a vertically-long rectangular opening 711 having a small width. The opening 711 is provided for attaching and detaching the CRUM 712, which is an integrated-circuit (IC) memory as an example of an integrated circuit having multiple first electrodes, to and from the plug housing 710. The integrated circuit includes not only the integrated circuit itself but also an integrated circuit mounted on a circuit substrate. The multiple electrodes included in the integrated circuit includes not only multiple electrodes (terminals) provided in the integrated circuit itself but also multiple electrodes that are provided in the substrate on which the integrated circuit is mounted and that are respectively connected to the multiple electrodes of the integrated circuit. As shown in FIG. 11, the CRUM 712 includes an IC substrate 713 formed of a printed substrate having a substantially rectangular shape in plan view. An electrically erasable programmable read-only memory (EEP-ROM) 714, which is a nonvolatile memory as an example of an integrated circuit, is mounted on a first surface of the IC substrate 713. A second surface of the IC substrate 713 is provided with multiple (four in FIG. 11) first electrodes $\mathbf{715}_1$ to $\mathbf{715}_4$ that are connected to the terminals of the EEP-ROM 714 and are exposed to the outside such that they are externally contactable. The four first electrodes $\mathbf{715}_1$ to $\mathbf{715}_4$ are respectively connected to a GND terminal, a CLK terminal, a VCC terminal, and a DATA terminal of the EEP-ROM 714. Although four first electrodes $\mathbf{715}_1$ to $\mathbf{715}_4$ are provided relative to the EEP-ROM 714 in the exemplary embodiment shown in FIG. 11, the number of first electrodes $\mathbf{715}_1$ to $\mathbf{715}_4$ is not limited to four and may be three or fewer or five or more. The number of electrode terminals of the EEP-ROM 714 and the number of first electrodes 715 do not have to be equal to each other, and the number of first electrodes 715 may be smaller than the number of electrode terminals of the EEP-ROM 714. In FIG. 11, reference characters 713*a* and 713*b* denote holes to be used when, for example, removing the CRUM 712 from the plug housing 710.

Accordingly, the CRUM 712 is a module that includes the EEP-ROM 714, which is a replaceable nonvolatile memory. The four first electrodes $\mathbf{715}_1$ to $\mathbf{715}_4$ of the IC substrate 713 each have an elongate rectangular shape in the inserting direction and are arranged parallel to one another with a predetermined distance therebetween in the direction intersecting the inserting direction. Of the four first electrodes $\mathbf{715}_1$ to $\mathbf{715}_4$, a GND electrode $\mathbf{715}_1$ disposed at one end protrudes toward the leading edge in the inserting direction and is given a length that is larger than those of the remaining electrodes $\mathbf{715}_2$ to $\mathbf{715}_4$. Therefore, when the CRUM 712 is inserted into the plug 71, the GND electrode $\mathbf{715}_1$ is first connected to one of contacts 723 of the receptacle 72, which will be described later, by being brought into contact therewith, and the remaining electrodes $\mathbf{715}_2$ to $\mathbf{715}_4$ are subsequently connected to the remaining contacts 723 of the receptacle 72 by being brought into contact therewith.

As shown in FIG. 8, the plug housing 710 includes a retainer 716 at one side surface thereof in a direction X intersecting an attaching-detaching direction Z. For example, by press-fitting the CRUM 712 with a small force, the retainer 716 retains the CRUM 712 in a secured state. The retainer 716 spatially communicates with the opening 711 provided in the end surface of the plug housing 710 and used for attaching and detaching the CRUM 712. The retainer 716 has a planar shape substantially similar to that of the IC substrate 713 of the CRUM 712. Opposite ends of the retainer 716 in a width direction Y intersecting the attaching-detaching direction Z of the CRUM 712 are respectively provided with a guide groove 716*a* and a guide wall 716*b*. The guide groove 716*a* guides a first edge of the CRUM 712 while covering front and rear surfaces thereof. The guide wall 716*b* guides a second edge of the CRUM 712 while being in contact therewith. Moreover, the leading end of the retainer 716 in the attaching-detaching direction Z is provided with a stopper wall 716*c* with which the leading edge of the CRUM 712 is brought into abutment so as to position the CRUM 712 in a retained state. Furthermore, the retainer 716 includes a recess 716*d* that is depressed inward from the one side surface of the plug housing 710 so as to accommodate the EEP-ROM 714 mounted on one surface of the CRUM 712. As shown in FIGS. 7 and 8, opposite ends of the recess 716*d* in the width direction Y intersecting the attaching-detaching direction Z are respectively provided with protrusions 717 that extend in the attaching-detaching direction Z and that guide the CRUM 712 by coming into contact with one surface of the CRUM 712. The CRUM 712 is retained with an appropriate retaining force by appropriately setting, for example, the width of the guide groove 716*a* of the retainer 716 and the spacing between the guide groove 716*a* and the guide wall 716*b* so that, in a state where the CRUM 712 is inserted in the plug housing 710, the CRUM 712 does not accidentally move even when an external force is applied to the process cartridge 30 during an attaching or detaching process thereof.

Figure 12A:
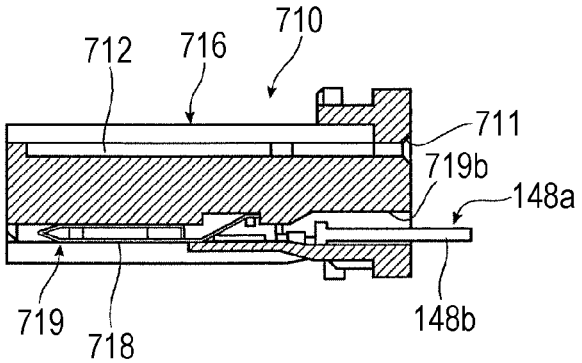
FIGS. 12A and 12B are cross-sectional views of the plug.
Figure 12B:
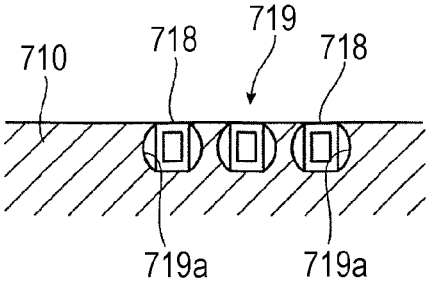

As shown in FIGS. 12A and 12B, a side surface of the plug housing 710 opposite the side thereof to which the CRUM 712 is inserted is provided with a second retainer 719 that securely retains multiple (three in FIGS. 12A and 12B) contacts 718 as an example of second electrodes to be connected to a wire harness 148*a* of the toner concentration sensor 148. The second retainer 719 is constituted of multiple (three in FIGS. 12A and 12B) grooves 719*a* that are provided in the attaching-detaching direction of the plug housing 710 at one end of the plug housing 710 in the direction intersecting the attaching-detaching direction. The base ends of the grooves 719*a* spatially communicate with an insertion hole 719*b* provided at the base end of the plug housing 710.

As mentioned above, the contacts 718, to which signal wires 148*b* of the wire harness 148*a* of the toner concentration sensor 148 are to be contact-bonded, are securely retained in the grooves 719*a* by, for example, press-fitting the contacts 718 therein. As shown in the lower part of FIG. 8, the contacts 718 are each formed into a hollow or solid rod shape, such as a prismatic shape or a columnar shape, with a pointy end 718*a* by bending or shaping a plate-shaped or rod-shaped electrically conductive material, such as a thin metal plate, by pressing where appropriate. A base end 718*b* of each contact 718 (i.e., the end to be connected to the wire harness 148*a* of the toner concentration sensor 148) is folded into a substantially U-shape in cross section so as to enhance rigidity and also to ensure the connection with the wire harness 148*a*. The base ends 718*b* of the contacts 718 are connected to the signal wires 148*b* of the wire harness 148*a* by, for example, contact bonding.

The contacts 718 are inserted through the insertion hole 719*b* and are securely retained in the grooves 719*a* so as to be fixed to predetermined positions in the plug housing 710. Moreover, each contact 718 is attached such that a portion thereof (i.e., the lower surface thereof in FIG. 12A) is exposed, thus making the contact 718 contactable from the outside.

As shown in FIG. 8, opposite outer side surfaces of the plug housing 710 in the direction Y intersecting the inserting direction Z of the CRUM 712 are respectively provided with grooves 719*c* for positioning the plug 71 relative to the receptacle 72 in the direction X intersecting the inserting direction Z when attaching the plug 71 to the receptacle 72.

Figure 13:
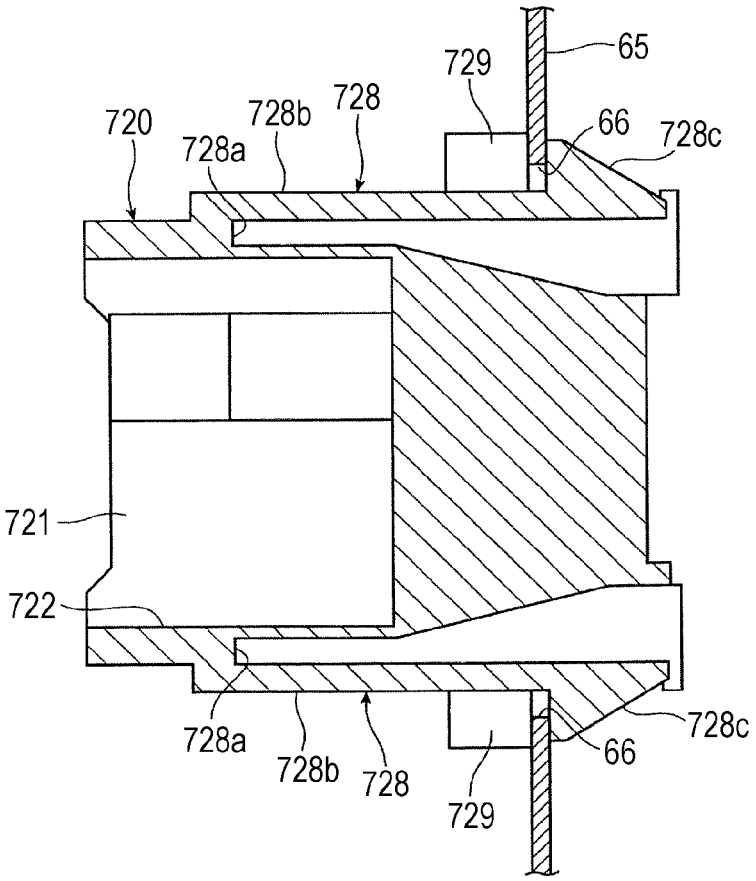
FIG. 13 is a cross-sectional view illustrating the receptacle in an attached state.

The receptacle 72 to be attached to the image forming apparatus body 1*a* includes a substantially-rectangular-parallelepiped receptacle housing 720 that is slightly larger than the plug 71 composed of an insulation material, such as synthetic resin. As shown in FIG. 7, the front end surface of the receptacle housing 720 is provided with a vertically-long-rectangular opening 721 used for attaching and detaching the plug 71. Furthermore, as shown in FIG. 13, in order to accommodate the plug 71 while being in spatial communication with the opening 721, the receptacle housing 720 is provided with a recess 722 therein, which has a shape corresponding to the outer peripheral shape of the plug 71.

Figure 14:
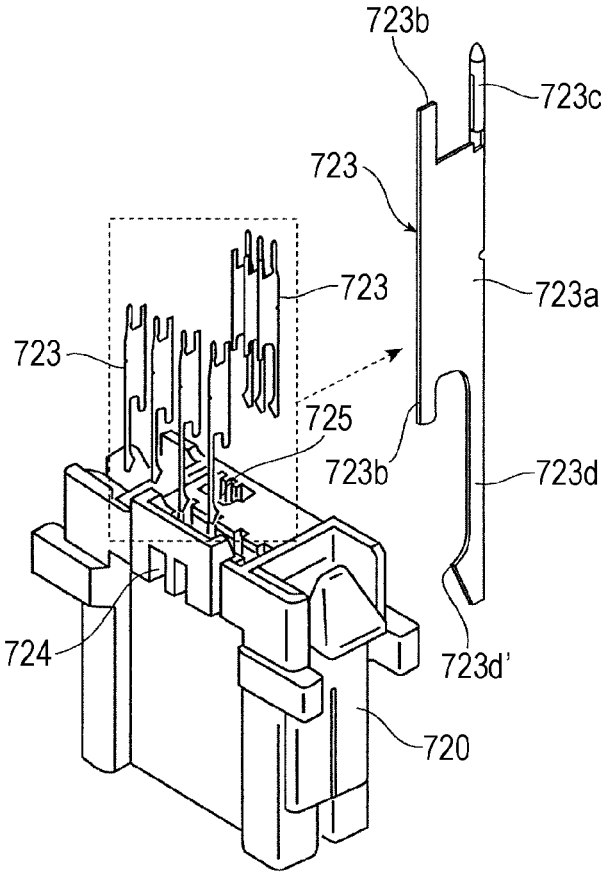
FIG. 14 is an exploded perspective view of the receptacle.

Furthermore, as shown in FIG. 14, the receptacle housing 720 includes a total of seven receptacle contacts 723, four on one side and three on the other side. The receptacle contacts 723 are provided as connection units that are directly connected to the multiple first electrodes $715_1$ to $715_4$ of the CRUM 712 and the multiple contacts $718_1$ to $718_3$ when the plug 71 is attached. The seven receptacle contacts 723 have identical configurations.

As shown in an enlarged view in FIG. 14, each receptacle contact 723 is formed into a substantially H-shape in front view by bending, connecting, or shaping a plate-shaped or rod-shaped electrically conductive material, such as a thin metal plate, by pressing where appropriate. The receptacle contact 723 has an intermediate portion 723*a* that forms an elongate rectangular flat plate. One long edge of the intermediate portion 723*a* forming an elongate rectangular flat plate is provided with locking segments 723*b* that protrude away from each other in the longitudinal direction of the intermediate portion 723*a* and that are to be securely fitted in the receptacle housing 720. The other long edge of the intermediate portion 723*a* is provided with a first connection segment 723*c* and a second connection segment 723*d* that protrude away from each other. The first connection segment 723*c* is to be connected to a signal wire of a wire harness 101, which is for connecting to the controller 100, by, for example, pressure contact. The second connection segment 723*d* is to be electrically connected to one of the multiple electrodes $715_1$ to $715_4$ of the CRUM 712 and one of the contacts $718_1$ to $718_3$ in the plug 71 by being brought into contact therewith. More specifically, the first connection segment 723*c* protrudes outward from the receptacle housing 720, whereas the second connection segment 723*d* protrudes inward to the receptacle housing 720. A side surface of the second connection segment 723*d* located toward the distal end thereof (i.e., a surface facing inwardly toward the recess 722) is provided with a small substantially-triangular protrusion 723*d*' that comes into contact with one of the multiple electrodes $715_1$ to $715_4$ of the CRUM 712 and one of the contacts $718_1$ to $718_3$ in the plug 71. The second connection segment 723*d* is formed to be longer than the first connection segment 723*c*.

Figure 15:
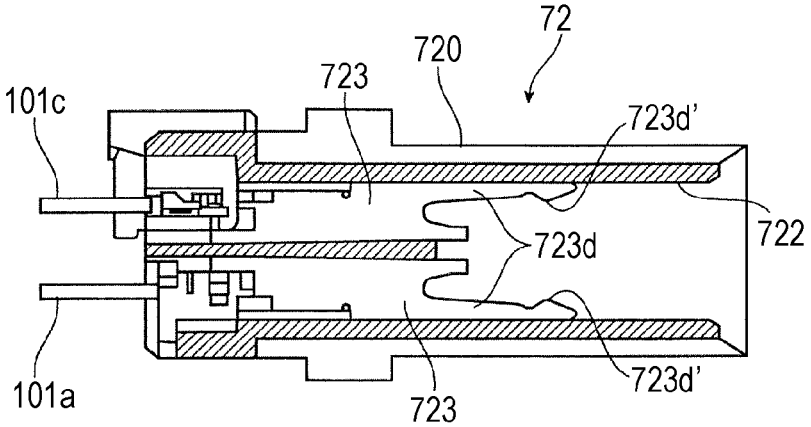
FIG. 15 is a cross-sectional view of the receptacle.

As shown in FIG. 14, the receptacle contacts 723 are fitted in a state where they are inserted into first and second recesses 724 and 725 provided in the base end surface of the receptacle housing 720 (i.e., the end surface thereof to be attached to the image forming apparatus body 1*a*). In this case, as shown in FIG. 15, the second connection segments 723*d* of the receptacle contacts 723 are securely positioned such that the protrusions 723*d*' thereof protrude to predetermined positions in the recess 722 in the receptacle housing 720. As a result, the protrusions 723*d*' of the second connection segments 723*d* of the receptacle contacts 723 are respectively positioned at positions corresponding to the four first electrodes $715_1$ to $715_4$ of the CRUM 712 of the plug 71 and the three contacts 718 ($718_1$ to $718_3$).

As shown in FIG. 14, the first and second recesses 724 and 725 of the receptacle housing 720 are provided with grooves 724*a* and 725*a* that are spaced apart by a predetermined distance for guiding and securely positioning the receptacle contacts 723. Moreover, as shown in FIG. 8, a four-pole pressure-contact socket 726 composed of synthetic resin or synthetic rubber for connecting four signal wires 101*a* of the wire harness 101, which is for connecting to the controller 100, to the first connection segments 723*c* of the receptacle contacts 723 by pressure contact are fitted to the first recess 724 of the receptacle housing 720 by, for example, press-fitting. The ends of the four signal wires 101*a* of the wire harness 101 have terminals 101*b* connected thereto by, for example, contact bonding. The terminals 101*b* connected to the signal wires 101*a* are secured in a state where they are inserted to predetermined positions of the pressure-contact socket 726, so that the terminals 101*b* and the first connection segments 723*c* of the receptacle contacts 723 are connected to each other by pressure contact inside the pressure-contact socket 726.

Furthermore, a three-pole pressure-contact socket 727 composed of synthetic resin or synthetic rubber for connecting three signal wires 101*c* of the wire harness 101, which is for connecting to the controller 100, to the first connection segments 723*c* of the receptacle contacts 723 by contact bonding is press-fitted to the second recess 725 of the receptacle housing 720. The three signal wires 101*c* of the wire harness 101 have terminals (not shown) similar to the terminals 101*b* connected to the ends thereof by, for example, contact bonding. Moreover, the terminals connected to the respective signal wires 101*c* are secured in a state where they are inserted in the pressure-contact socket 727, and the terminals and the first connection segments 723*c* of the receptacle contacts 723 are connected to each other by pressure contact inside the pressure-contact socket 727.

As shown in FIG. 13, the receptacle housing 720 includes an attachment portion 728 to be attached to the image forming apparatus body 1*a*. The attachment portion 728 is constituted of snap joining portions provided at opposite side surfaces of the receptacle housing 720. The attachment portion 728 includes side plates 728*a* that are provided at opposite sides of the opening 721 in the receptacle housing 720 and that slightly protrude outward, and flexible plates 728*b* that extend substantially parallel to the opposite side surfaces of the receptacle housing 720 from the outer edges of the side plates 728*a* and that are relatively thin so as to be bendable. The end of each flexible plate 728*b* is provided with an engagement projection 728*c* that is substantially triangular in cross section and that protrudes laterally from the surface of the flexible plate 728*b*. The ends of the two engagement projections 728*c* are separated from each other by a distance that is smaller than the opening width of an opening 66 in the internal frame 65, which will be described below.

Furthermore, the base end of the receptacle housing 720 is provided with positioning portions 729 used for positioning the receptacle housing 720 in the attaching-detaching direction by being brought into contact with the internal cover 62 of the image forming apparatus body 1*a*. The positioning portions 729 are provided at four locations corresponding to the four corners at the base end of the receptacle housing 720.

Figure 16:
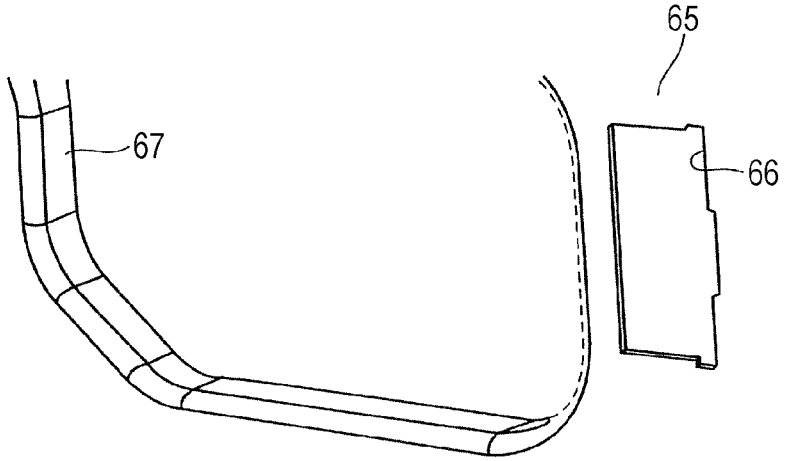
FIG. 16 is a perspective view of an attachment portion of the receptacle.

As shown in FIG. 16, the internal frame 65 of the image forming apparatus body 1*a* is provided with the opening 66 having a substantially rectangular shape that is slightly larger than the outer shape of the receptacle housing 720 so that the receptacle housing 720 of the receptacle 72 is insertable through the opening 66. The opening width of the opening 66 is larger than the width of the receptacle housing 720, and the opening height of the opening 66 is larger than the height of the receptacle housing 720 (i.e., the distance between the left and right flexible plates 728*b* to be described later). In FIG. 16, reference character 67 denotes an opening provided in the internal frame 65 for attaching and detaching the process cartridge 30.

As shown in FIG. 13, with regard to the receptacle 72, the receptacle housing 720 is inserted through the opening 66 formed in the internal frame 65 of the image forming apparatus body 1*a* and is pushed until the positioning portions 729 of the receptacle housing 720 come into contact with the surface of the internal frame 65 of the image forming apparatus body 1*a*, so that the inclined surfaces of the substantially-triangular engagement projections 728*c* included in the attachment portion 728 constituted of the snap joining portions come into contact with the inner peripheral edge of the opening 66 of the internal frame 65, thereby causing the left and right flexible plates 728*b* to elastically bend inward. When the base ends of the engagement projections 728*c* have passed through the opening 66, the left and right flexible plates 728*b* restore their original shape. Accordingly, in a state where the internal frame 65 is securely clamped by the positioning portions 729 and the engagement projections 728*c*, the receptacle housing 720 is securely attached to a predetermined position of the image forming apparatus body 1*a*. In this case, since there is a gap between the opening 66 of the image forming apparatus body 1*a* and the receptacle housing 720, the receptacle housing 720 is allowed to move within the range of the gap in the direction intersecting the attaching direction of the receptacle 72.

Operation of Characteristic Section of Image Forming Apparatus

In the image forming apparatus 1 to which the connector 70 according to this exemplary embodiment is applied, the process cartridge 30 is replaced in the following manner.

As shown in FIG. 7, with regard to the process cartridge 30, the controller 100 is capable of reading and writing information related to, for example, the lifespan of the photoconductor drum 11 stored in the CRUM 712 via the connector 70, and the controller 100 is capable of receiving a detection signal from the toner concentration sensor 148 via the wire harness 148*a*. When the controller 100 determines that a predetermined replacement condition is satisfied, such as when the controller 100 determines that the layer thickness of the photoconductor layer of the photoconductor drum 11 has decreased to a predetermined value, based on the information related to, for example, the lifespan of the photoconductor drum 11 stored in the CRUM 712, the controller 100 causes, for example, the user interface or the display screen of the personal computer connected to the image forming apparatus 1 to display a message prompting a user to replace the process cartridge 30 with a new one. As shown in FIG. 5, when replacing the process cartridge 30, the process cartridge 30 is pulled toward the front side of the image forming apparatus body 1*a* in a state where the front cover 60 of the image forming apparatus 1 is opened, and the used process cartridge 30 is removed from the image forming apparatus body 1*a*.

In this case, as shown in FIG. 3, the plug 71 provided at the process cartridge body 31 moves toward the front side of the image forming apparatus body 1*a* as the process cartridge 30 moves, and the plug 71 is removed from the receptacle 72 provided at the image forming apparatus body 1*a*.

Subsequently, a new process cartridge 30 is inserted to a predetermined position inside the image forming apparatus body 1*a* through the opening 63 provided in the front surface of the image forming apparatus body 1*a*. As a result of this inserting process of the process cartridge 30, the plug 71 of the connector 70 provided at the process cartridge 30 becomes attached to the receptacle 72 provided at the image forming apparatus body 1*a*. Then, the front cover 60 of the image forming apparatus 1 is closed.

Figure 17:
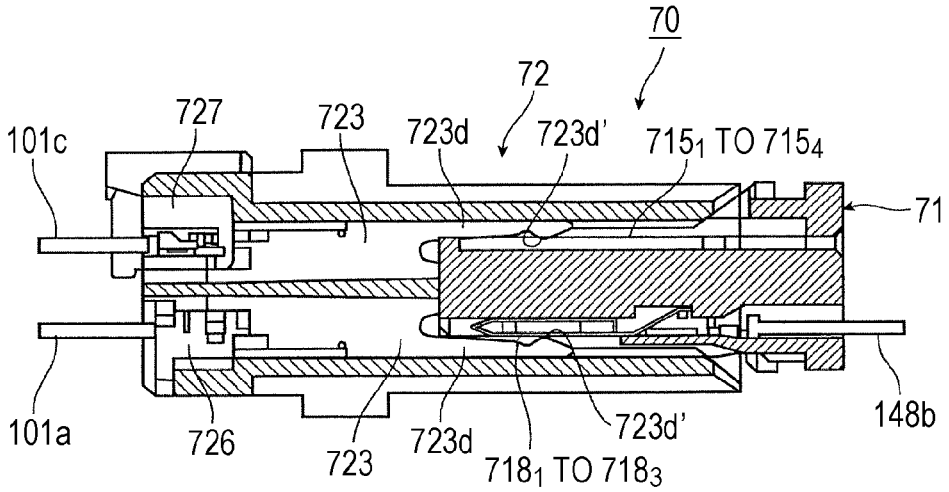
FIG. 17 is a cross-sectional view illustrating a state where the plug and the receptacle of the connector are attached to each other.

As shown in FIG. 17, when the plug 71 of the connector 70 is attached to the receptacle 72, the four electrodes $\mathbf{715}_1$ to $\mathbf{715}_4$ of the CRUM 712 exposed at one side surface of the plug 71 and the four contacts 723 disposed at one side surface inside the receptacle 72 come into contact or pressure contact with each other, and the three contacts $\mathbf{718}_1$ to $\mathbf{718}_3$ connected to the wire harness 148*a* of the toner concentration sensor 148 exposed at the other side surface of the plug 71 and the three contacts 723 disposed at the other side surface inside the receptacle 72 come into contact or pressure contact with each other, whereby an electrical connection is established. As a result, the toner concentration sensor 148 and the CRUM 712 of the process cartridge 30 become capable of exchanging signals (i.e., become communicable) with the controller 100 in the image forming apparatus body 1*a*.

More specifically, as shown in FIG. 17, when the plug 71 is attached to the receptacle 72, the protrusions 723*d*' of the second connection segments 723*d* of the receptacle contacts 723, which are disposed at one side, come into contact with the four first electrodes $\mathbf{715}_1$ to $\mathbf{715}_4$ of the CRUM 712, and the protrusions 723*d*' of the receptacle contacts 723, which are disposed at the other side, come into contact with the three contacts 718 connected to the toner concentration sensor 148, so as to become respectively connected to the CRUM 712 in the plug 71 and the toner concentration sensor 148.

The contact pressure of the receptacle contacts 723 relative to the four first electrodes $\mathbf{715}_1$ to $\mathbf{715}_4$ and the three contacts $\mathbf{718}_1$ to $\mathbf{718}_3$ is appropriately set in accordance with, for example, the arrangement and the shape of the receptacle contacts 723 relative to the receptacle housing 720.

Accordingly, in the connector 70 according to the above exemplary embodiment, the plug 71 provided at the process cartridge 30 is not provided with a connection unit, such as connection terminals, for electrically connecting to the CRUM 712 fitted in the plug 71 and the wire harness 148*a* extending from the toner concentration sensor 148, so that the configuration of the plug 71 may be simplified. Moreover, since the plug 71 provided at the process cartridge 30 is not provided with a connection unit, the plug 71 may be reduced in size and the component cost may be reduced. In addition, the process cartridge 30 to which the plug 71 is attached may also be reduced in size, and the image forming apparatus 1 may also be reduced in size.

Although the exemplary embodiment described above is applied to a monochrome image printing apparatus as an image forming apparatus, the exemplary embodiment may alternatively be applied to a full-color image forming apparatus equipped with an image forming device corresponding to yellow (Y), magenta (M), cyan (C), and black (K) colors.

Furthermore, although the exemplary embodiment described above relates to a connector equipped with a plug and a receptacle, the connector may alternatively be constituted of a combination of, for example, a male plug and a female plug.

Furthermore, although the exemplary embodiment described above relates to a case where a connector is applied to an image forming apparatus, the connector may alternatively be applied to an apparatus, such as an image reading apparatus, other than the image forming apparatus.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A connector comprising:

a first connector that retains in a secured state an integrated circuit having a plurality of first electrodes, wherein the integrated circuit is externally contactable with the plurality of first electrodes; and a second connector that is attachable to and detachable from the first connector, wherein the second connector comprises a connection unit that is directly connected to the plurality of first electrodes of the integrated circuit when the first connector is attached to the second connector, wherein the first connector includes a plurality of second electrodes that are connected to a signal line extending from a location other than the integrated circuit the plurality of second electrodes being secured in an externally contactable manner, and wherein the second connector comprises a second connection unit that is directly connected to the plurality of second electrodes when the first connector is attached to the second connector.

2. A process cartridge comprising:

a process cartridge body that is attachable to and detachable from an image forming apparatus body; and a first connector that is attachable to and detachable from a second connector having a connection unit at the image forming apparatus body, the first connector retaining an integrated circuit having a plurality of first electrodes, which are directly connected to the connection unit, in a secured state when the first connector is attached to the second connector at the image forming apparatus body, wherein the first connector includes a plurality of second electrodes that are connected to a signal line extending from a location other than the integrated circuit, the plurality of second electrodes being secured in an externally contactable manner, and wherein the second connector comprises a second connection unit that is directly connected to the plurality of second electrodes when the first connector is attached to the second connector.

3. An image forming apparatus comprising:

an image forming apparatus body;

a process cartridge that is attachable to and detachable from the image forming apparatus body;

a first connector that is provided at the process cartridge, wherein the first connector retains, in a secured state, an integrated circuit having a plurality of first electrodes, and wherein the integrated circuit is externally contactable with the plurality of first electrodes; and a second connector that is provided at the image forming apparatus body, wherein the second connector is attachable to and detachable from the first connector, wherein the second connector comprises a connection unit that is directly connected to the plurality of first electrodes of the integrated circuit when the first connector is attached to the second connector, wherein the first connector includes a plurality of second electrodes that are connected to a signal line extending from a location other than the integrated circuit, the plurality of second electrodes being secured in an externally contactable manner, and wherein the second connector comprises a second connection unit that is directly connected to the plurality of second electrodes when the first connector is attached to the second connector.

* * * * *